US005183384A

United States Patent [19]

Trumbly

[11] Patent Number: 5,183,384

[45] Date of Patent: Feb. 2, 1993

[54] FOLDABLE PROPELLER ASSEMBLY

[76] Inventor: Joe H. Trumbly, 197 Raft Island, Gig Harbor, Wash. 98335

[21] Appl. No.: 194,510

[22] Filed: May 16, 1988

[51] Int. Cl.[5] ..... B63H 1/06; B63H 1/22

[52] U.S. Cl. ..... 416/87; 416/142

[58] Field of Search ..... 416/142 R, 142 A, 202, 416/87, 89

[56] References Cited

U.S. PATENT DOCUMENTS

| | | | |
|---|---|---|---|
| D. 141,235 | 5/1945 | Birsh | 416/142 R |
| 938,291 | 10/1909 | Thompson | 416/142 A |
| 993,126 | 5/1911 | Thompson | 416/142 A |
| 1,771,365 | 7/1930 | Woll | 416/202 |
| 3,255,826 | 6/1966 | Beck | 496/142 A |
| 3,982,853 | 9/1976 | Beck | 416/142 A |
| 4,204,806 | 5/1980 | Blanchard | 416/142 A X |
| 4,364,711 | 12/1982 | Brandt et al. | 416/142 A |

FOREIGN PATENT DOCUMENTS

| | | | |
|---|---|---|---|
| 860029 | 12/1952 | Fed. Rep. of Germany | 416/202 |
| 2013481 | 10/1970 | Fed. Rep. of Germany | 416/202 |
| 3246635 | 6/1984 | Fed. Rep. of Germany | 416/142 R |
| 26090 | of 1909 | United Kingdom | 416/202 |
| 116009 | 5/1918 | United Kingdom | 416/142 A |
| 349450 | 5/1931 | United Kingdom | 416/202 |

*Primary Examiner*—Edward K. Look
*Assistant Examiner*—Hoang Nguyen
*Attorney, Agent, or Firm*—R. Reams Goodloe, Jr.

[57] ABSTRACT

A marine propeller assembly which folds completely parallel to a drive shaft axis when the boat motor is disengaged is disclosed. When the boat motor is disengaged the propeller blades fold rearward due to the force caused by the moving water under the boat. When the boat motor is engaged and the drive shaft beings to rotate, the centrifugal force causes the propeller blades to extend out 90 degrees to the drive shaft.

2 Claims, 3 Drawing Sheets

22
38
BLADE 1
24
BLADE 2
38
20
30
32
28
12
14
16
10
36
18
28
34
30
26
BLADE 3
38

FOLDABLE PROPELLER ASSEMBLY

BACKGROUND OF THE INVENTION

The invention relates to marine propellers, and more particularly to a foldable triple-bladed marine propeller which does not require any mechanical means to operate. This folding propeller works off of the natural flow of the moving water under the boat when the boat engine is disengaged.

This invention also features a triangular shaped hub to which the propeller blades fasten onto the sides of the hub. This improvement reduces drag and improves symmetry around the drive shaft.

Several patents have been discovered by applicant to be pertinent to the instant application. They are U.S Pat. No. 1,491,512; 1,851,513; 123,733; 997,884; 725,097; 598,337; 3,709,634; and British patent Nos. 2,356 and 116,009. These patents teach various means to collapse or fold blades on two, three, and four propeller assemblies through mechanical means. Only British patent No. 116,009 teaches collapse or folding of the propeller blades by natural forces. However, British patent No. 116,009 is readily distinguishable from the Trumbly invention.

British patent No. 116,009 teaches a similar marine propeller device which collapses or folds by natural forces. However, patent No. 116,009 is distinguishable from the present invention in that the present invention teaches three separate and foldable blades connected to the three sides of the triangular shaped hub. The present invention allows the three separate, foldable blades to fold symmetrically around the drive shaft and triangular hub, thus reducing drag, when the propeller is not in use, more effectively than patent # 116,009. Patent # 116,009 does not anticipate the triangular hub and three separate, foldable propeller blades, but rather teaches an "enlarged portion at the after end of the tail shaft" to which propeller blades are attached. In the case of four bladed propellers the blades are in pairs; for three bladed propellers, two of the blades are a solid inseparable device; consequently patent # 116,009 cannot attain the symmetry of the present invention. The solid pairs of blades anticipated in patent # 116,009 cannot fold to fit closely around the drive shaft, thus producing more drag and less efficiency than the present invention.

SUMMARY OF THE INVENTION

This foldable triple-bladed marine propeller and attaching triangular shaped hub provide a novel and effective propeller assembly device which folds completely parallel to the engine drive shaft axis when the boat engine is disengaged.

When the boat engine engages, the drive shaft turns the propeller blades and the centrifugal force opens the blades to extend out 90 degrees to the drive shaft thereby attaining maximum thrust from the spinning blades.

When the boat engine disengages, the drive shaft stops turning and as the boat moves forward, the blades automatically fold rearward thus causing a minimum of drag.

The propeller blades are attached to the sides of a triangular shaped hub which is in turn attached to the drive shaft.

These and other related objects, advantages, and features will be apparent upon studying the following specification along with the drawings.

BRIEF DESCRIPTION OF THE DRAWINGS

1.

DETAILED DESCRIPTION

Figure 1:
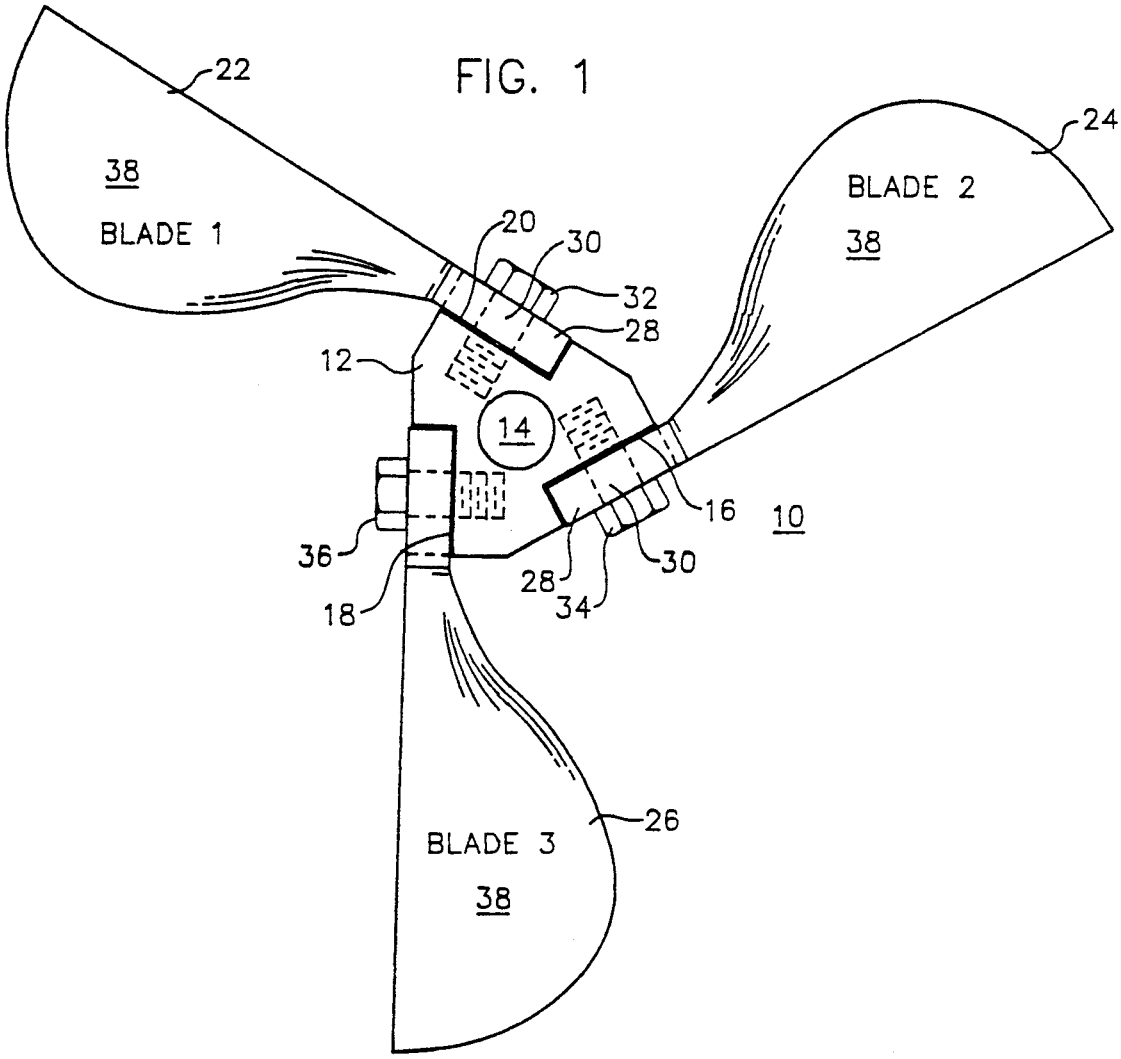
FIG. 1 is a plan view of the propeller blades in an extended position.
2.

In FIG. 1, the rotatable propeller assembly 10 is shown in a plane view with the propeller blades in an extended position.

As set forth in the figure, a propeller hub 12 is attached to a shaft 14. The propeller hub 12 provides three surfaces, 16, 18 and 20. The three surfaces of the hub are at equal angles to each other. The surfaces are extended a sufficient distance to allow for a propeller blade 22, 24, 26, when they are in a folded, rearward position to lie parallel to shaft 14.

Each of the propeller blades 22, 24, and 26, utilize a stem 28 with a hole 30 through which bolt 32 passes. The propeller stem width is approximately the width of the surfaces 16, 18 and 20.

The bolt 32 is designed to have a diameter less than the hole 30 which allows for the rotation of the propeller blade. Each of the propeller blades act independently in regard to the three bolts 32, 34 and 36, that are secured to their respective surfaces through the propeller blades holes 30.

The face 38 of the propeller blades are attached to the stem 28 such that the plane defined generally by the face of the blade intersects with the surfaces 16, 18, 20 and the shaft 14 at approximately a 90 degrees angle when the propellers are extended.

Figure 2:
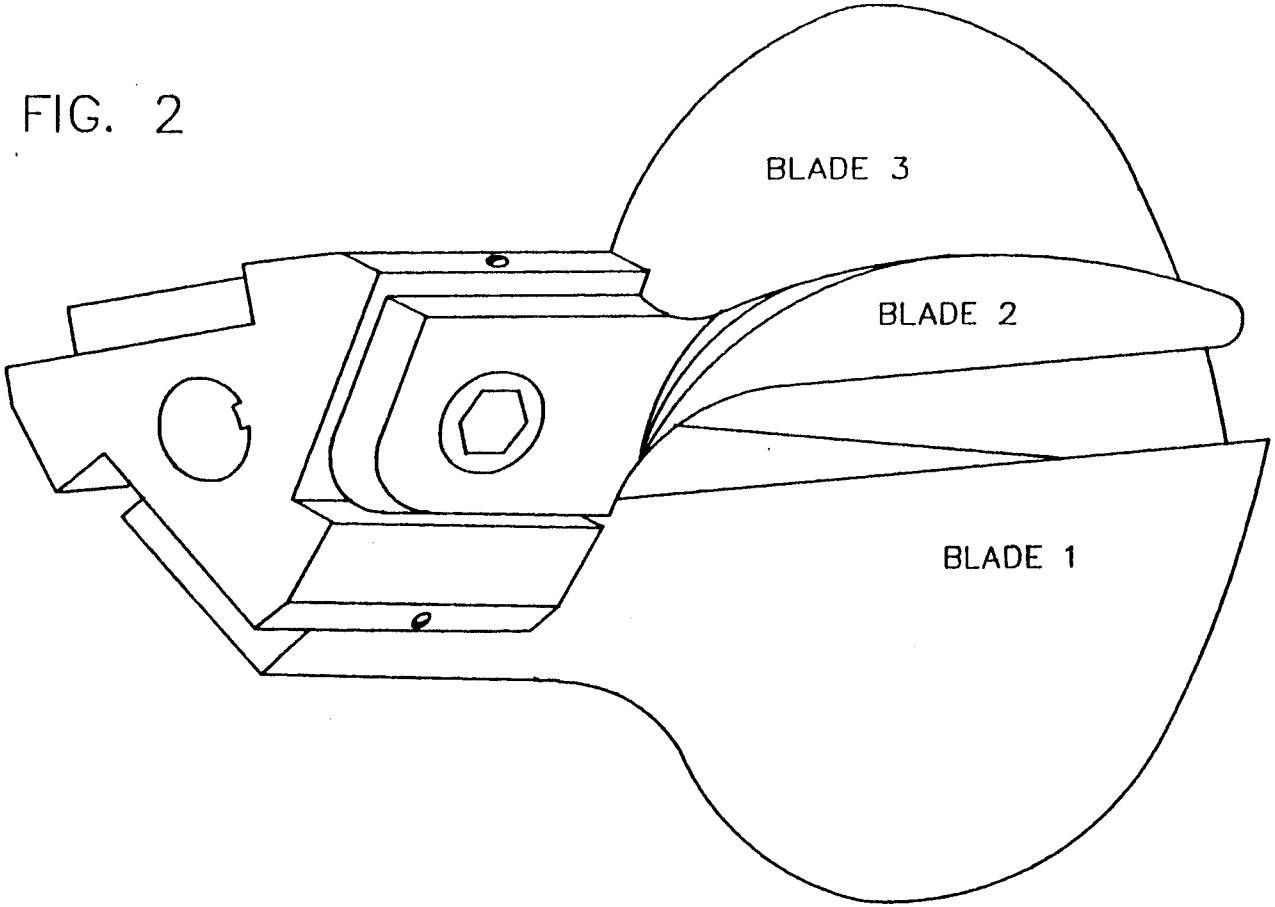
FIG. 2 is a prospective view of the propeller blades in a folded position.
3.

When the motor is off, the propeller blades, due to the force caused by the moving water under the boat, fold rearward. When in the rearward position as illustrated in FIG. 2, the blades present a minimum of drag.

When the motor is engaged and the shaft 14 beings to rotate, the centrifugal force causes the blades to extend out 90 degrees in relation to the shaft as set forth in FIG. 1.

Figure 3:
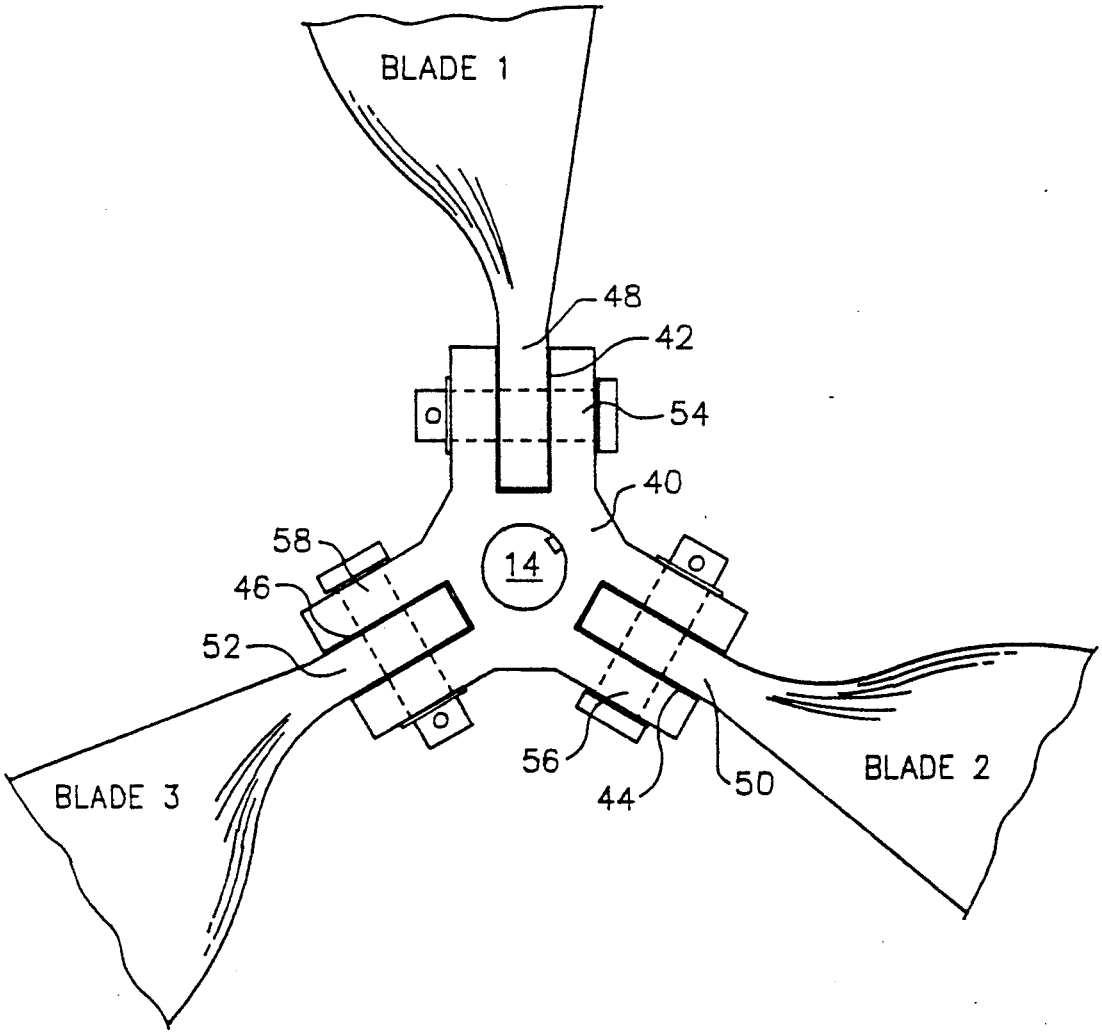
FIG. 3 is a plan view of a second configuration of the hub, with the propeller blades in an extended position.

In FIG. 3, a second configuration is illustrated. In the second configuration the hub 40 is secured to shaft 14. The hub utilizes three slots, 42, 44, and 46. The planes defined by the three slots intersect one another also at equal angles.

Each of the three slots house propeller stems 48, 50 and 52. The propeller stems are held in position based on holes 54, 56 and 58 which are positioned through the stem of the propeller blades and through the slots 42, 44 and 46. When bolts pass through said holes, the propeller blades themselves are capable of folding. Thus, when the motor is off, the blades, due to force caused by moving water under the boat, are folded rearward. Similarly, when the motor is engaged and the shaft 14 begins to rotate, the centrifugal force causes the blades to extend out 90 degrees in relation to the shaft 14.

Thus, both designs are effective as they are extended in driving the craft. Once again, when the motor is turned off, the force of water passing by the propeller blades forces the propeller blades rearward, thereby assuming the position parallel to the drive shaft.

I claim:

1. A folding propeller assembly suitable for attachment to a shaft for use in marine propulsion, comprising:

a propeller hub, said hub having a central axis of rotation and three slots each having opposing sides, said slots positioned such that the planes defined by the said slots intersect at equal angles;

three propeller blades, said blades comprising a propeller stem connected to a working face a means of attaching said blades to said slots, wherein said last mentioned means further comprises a bolt positioned through said opposing sides of each of said slots, wherein said blades lie, when said hub is not rotating, in a plane substantially parallel to the said central axis of rotation, and such that when said hub is rotated about said axis, the centrifugal force caused by said rotation causes said propeller blades to extend to an angle that is effective so as to cause said blades to provide propulsion.

2. The folding propeller assembly of claim 1, wherein the planes defined by said blades intersect, at the hub, at equal angles.

* * * * *